US008256399B2

(12) United States Patent
Gamache et al.

(10) Patent No.: US 8,256,399 B2
(45) Date of Patent: Sep. 4, 2012

(54) AUTOMATIC MANAGEMENT AND CONTROL SYSTEM FOR CONTROLLING ACCESSORIES AND ENGINE CONTROLS OF A TRANSPORT MOTORED VEHICLE

(75) Inventors: Gaétan Gamache, St.-Antonin (CA); Alain Gamache, St.-Antonin (CA)

(73) Assignee: J.M. Bastille Transport Inc., Riviere-du-Loup, Quebec (CA)

( * ) Notice: Subject to any disclaimer, the term of this patent is extended or adjusted under 35 U.S.C. 154(b) by 906 days.

(21) Appl. No.: 12/318,922

(22) Filed: Jan. 13, 2009

(65) Prior Publication Data

US 2010/0100306 A1 Apr. 22, 2010

(30) Foreign Application Priority Data

Oct. 21, 2008 (CA) ..... 2641339

(51) Int. Cl.
*F02D 41/00* (2006.01)

(52) U.S. Cl. ..... 123/339.16; 123/343; 123/198 DC; 123/179.4

(58) Field of Classification Search ..... 123/339.16–339.18, 343, 349, 359, 198 D, 198 DC, 198 DB, 123/179.4
See application file for complete search history.

(56) References Cited

U.S. PATENT DOCUMENTS

| | | | | |
|---|---|---|---|---|
| 1,263,637 | A | 6/1918 | Olmsted | |
| 1,287,266 | A | 12/1918 | Eberly | |
| 4,381,042 | A | 4/1983 | Perry | |
| 4,419,866 | A | 12/1983 | Howland | |
| 4,421,075 | A | 12/1983 | Mandel | |
| 4,520,271 | A | 5/1985 | Goertler et al. | |
| 5,072,703 | A | 12/1991 | Sutton | |
| 5,140,826 | A | 8/1992 | Hanson et al. | |
| 5,186,015 | A | 2/1993 | Roehrich et al. | |
| 5,222,469 | A | 6/1993 | Sutton | |
| 5,275,011 | A | 1/1994 | Hanson et al. | |
| 5,317,998 | A | 6/1994 | Hanson et al. | |
| 5,644,924 | A | 7/1997 | Carr et al. | |
| RE36,437 | E | 12/1999 | Hanson et al. | |
| 6,363,906 | B1 | 4/2002 | Thompson et al. | |
| 6,595,180 | B2 | 7/2003 | Thompson et al. | |
| 6,768,221 | B2 | 7/2004 | Klinger et al. | |
| 6,895,917 | B2 | 5/2005 | Itoh et al. | |
| 7,003,395 | B1 * | 2/2006 | Thompson et al. | 701/113 |
| 7,027,912 | B1 | 4/2006 | Metzger | |
| 7,036,477 | B1 * | 5/2006 | Thompson et al. | 123/179.4 |
| 7,091,629 | B2 | 8/2006 | Hawkins | |
| 7,146,959 | B2 * | 12/2006 | Thompson et al. | 123/179.4 |
| 7,290,517 | B2 | 11/2007 | Marchand et al. | |
| 7,310,576 | B1 | 12/2007 | Letang | |
| 2004/0055558 | A1 | 3/2004 | McElroy | |

* cited by examiner

*Primary Examiner* — John Kwon
(74) *Attorney, Agent, or Firm* — Norton Rose Canada LLP

(57) ABSTRACT

An automatic management and control system for controlling a transport motored vehicle engine idle conditions, operation of vehicle accessories and engine controls when the vehicle is at a rest condition. This system has a controlled unit with a programmable computer having a memory for storing instructions for execution of an interactive management control program by the control unit. The control unit is conditioned by the operator of the vehicle to operate in a cabin heating mode or a cabin air-conditioning mode. The control unit is also conditioned by the control program to enable a defeat protection circuit to control a fast idle switch function in the cabin to prevent a vehicle operator person to attempt to override a idle shut-down mode of the control module when enabled for a set time period whereby to ensure autonomous automatic engine control by the control unit when the vehicle is in the rest condition with the control unit enabled to thereby optimize fuel efficiency.

32 Claims, 8 Drawing Sheets

18
60
84
31
57
58
21
59
23
71''
R6
51
R5
39
R4
37
R3
43
R2
36
R1
47
R20
65
R22
49
71'
R9
R25
73
74
55
17
13
16

AUTOMATIC MANAGEMENT AND CONTROL SYSTEM FOR CONTROLLING ACCESSORIES AND ENGINE CONTROLS OF A TRANSPORT MOTORED VEHICLE

TECHNICAL FIELD

The present invention relates to an automatic management and control system for controlling vehicle accessories and engine controls of a transport motored vehicle when the vehicle is at a rest condition whereby to optimize fuel efficiency.

BACKGROUND ART

With the high cost of fuel it is important to prevent excessive use of fuel when the engine of a transport motored vehicle is running at idle conditions. Because operators of such vehicles work for fleet operators who are the proprietors of the vehicles, they are not too concerned with the condition of the engine of the transport vehicle nor how much unnecessary fuel is consumed by the vehicle when the vehicle is stopped for any reason such as when the operator uses the sleeper unit of the cabin or leaves the engine running while at a restaurant eating or for any other reasons wherein the vehicle engine is left running at idle for long periods of time. It is know that unnecessary engine idling waist fuel and increase engine maintenance costs while reducing the life of the engine. Unnecessary idling also generates unnecessary exhaust emissions that are released into the atmosphere. It has been found that gasoline engines consume two and a half to four or more liters of fuel per hour while idling and diesel engines consume one to four liters per hour during idling and this being dependent on the size of the engine, and the idle speed of the engine dependant on accessory loads and power take-offs.

Another problem associated with truck engines when idling for prolonged period of times is that the engine oil becomes contaminated more quickly than when the vehicle is in movement. Idling also causes incomplete combustion and condensation of unburnt fuel on the cylinder walls of the engine and eventually contaminates the engine oil and reduces the effectiveness and the oil loses his lubrication quality. Accordingly, engine oil must be changed more frequently and this adds to the costs of the maintenance. Because the transport vehicle is out of service during maintenance, this also adds to the operating costs of the vehicle.

In recent years there has been requirements by certain states of the Unites States to limit engine idling to conform to state laws as well as local jurisdictions which impose restrictions on engine idling for the purpose of controlling $CO_2$ emissions. Many of these laws are not obeyed by truck operators as their vehicle is often not visible for inspection by state enforcing personnel. For example, often when a transport vehicle is being loaded or unloaded the operator will leave the vehicle at idle or even fast idle depending on local climatic conditions whereby the cabin heating system will remain operative.

Various devices have been provided in an attempt to conserve fuel. For example, many transport vehicles are now equipped with automatic idle shut-down devices whereby when the vehicle is at idle speed, the engine automatically shuts down after a predetermined time limit, usually 5 minutes. However, operators have found ways around these automatic engine idle control devices and such ways have been proven to be even more costly, such as engaging the fast idle switch to bypass the automatic idle shut-down or using the PTO of the vehicle to operate the engine at fast idle. Generators are also available that draw fuel from the transport vehicle tank to produce electricity for heat, air-conditioning and other appliances during idle conditions. However, this approach also consumes fuel and is therefore not a popular solution.

Another problem associated with engine idle is that it contributes to driver fatigue and reduces safety. Because there is a need to have heat or air-conditioning in a sleeper unit of the cabin of the transport motored vehicle, the engine has to be started during the sleeping period. Therefor, the driver which must set an alarm to wake himself at certain hours to ensure that the engine is started periodically to provide heat or air-conditioning and also to ensure, during very cold weather conditions, that the engine will be warm enough to start after the driver's sleeping period. Often, to bypass the need of having to start the engine during the rest or sleeping period an operator often will leave the engine running at idle during the entire sleeping period but the noise and vibrations generated by the idling diesel engine will affect the driver's good night rest and this solution also results in fatigue and unnecessary fuel consumption and wear. To remedy this problem, automatic heating and air-conditioning systems have been developed which are operated by supplemental batteries or generators, the latter being a costly solution as generators are bulky and costly. Many of these are also not compatible with all vehicles and they significantly increase the total weight of the vehicle and consequently affect fuel economy during driving. Generators are also noisy when in operation and are therefore not popular with truck drivers.

Operators are also known to tamper with engine sensors and actuators to bypass the idle speed shut-down control and circumvent or defeat various engine control features which improve fuel economy whereby the operator can obtain more power or speed or keep the engine running.

In view of the above there is a need to provide an automatic management and control system which can autonomously control a transport motored vehicle engine conditions, operation of vehicle accessories and engine controls when the vehicle is at rest condition and which is capable of preventing the vehicle operator from overriding the automatic operation of the system. Thus, the control system optimizes fuel efficiency.

SUMMARY OF INVENTION

It is a feature of the present invention to provide an automatic management and control system for controlling a transport motored vehicle engine idle conditions, operation of vehicle accessories and engine control when the vehicle is at a rest condition and which substantially overcomes all of the above-mentioned disadvantages of the prior art.

Another feature of the present invention is to provide an automatic management and control system which has a defeat protection circuit to have full control of the fast idle cruise switch in the cabin of the vehicle to prevent a vehicle operator person to attempt to override an automatic idle shut-down mode of the system.

Another feature of the present invention is to provide an automatic management and control system which is engageable by the operator only when the parking brake engages the vehicle truck wheels.

Another feature of the present invention is to provide an automatic management and control system which can be inputted by the operator to select a cabin heating or cabin cooling mode of operation of the system.

Another feature of the present invention is to provide an automatic management and control system which controls an auxiliary heater and air-conditioning unit in the sleeper unit of the truck cabin which is operated by auxiliary batteries.

Another feature of the present invention is to provide an automatic management and control system having an auxiliary battery pack which is monitored and automatically charged by the main batteries of the vehicle, as determined and enabled by the system, to ensure continuous operation of an auxiliary heater and air-conditioner of a sleeper unit of the truck cabin.

Another feature of the present invention is to provide an automatic management and control system which is provided with a screen to display all of the program functions and monitored parameters associated to the operator of the vehicle and other authorized personel for access to information.

Another feature of the present invention is to provide an automatic management and control system which is provided with an automatic engine idle shut-down at all times when the engine is operating.

Another feature of the present invention is to provide an automatic management and control system which is provided with autonomous automatic control of the fast idle for operating a PTO or charging batteries or operating a compressor or maintaining the engine in a temperature range suitable for start-up during cold weather conditions of for any other application of fast idle.

Another feature of the present invention is to provide an automatic management and control system which automatically controls an auxiliary engine coolant heater device which heats and circulates the engine cooling liquid and which device is operated by the vehicle battery and/or auxiliary batteries.

Another feature of the present invention is to provide an automatic management and control system which controls engine operations during PTO or compressor air charging modes to prevent unnecessary fast idling.

Another feature of the present invention is to provide an automatic management and control system which ensures continuous autonomous operation with the ignition key of the vehicle having been removed from the ignition and the doors of the vehicle locked and in the absence of the operator person.

Another feature of the present invention is to provide an automatic management and control system incorporating therein a plurality of security features associated with the plurality of vehicle accessories and engine controls when the vehicle is at a rest condition.

According to the above-mentioned features, form a broad aspect, the present invention provides an automatic management and control system for controlling a transport motored vehicle engine idle conditions, operation of vehicle accessories and engine controls when the vehicle is at a rest condition. The transport motored vehicle has a main battery supply to support an electrical load associated therewith. The system comprises a control unit with a programmable computer having a memory for storing instructions for execution of an interactive management control program by the control unit. A timer is associated with the computer. The control unit is interfaced with actuable switching devices for controlling said vehicle accessories, and the engine controls. Actuable switch means is provided to enable the control unit through enabling switch means when the vehicle is at the rest condition and when a transmission of the vehicle is at a neutral position and when an ignition switch of the vehicle is at a disabled "off" position. A display means having means to access visual displays of set programmed parameters and monitored parameters associated with a control unit is also provided. Mode selection switch means is provided to condition the control unit to operate in a cabin heating mode or a cabin air-conditioning mode. Sensor means monitors cabin temperature to provide temperature signals representative of actual cabin temperature to the control unit. The control unit is conditioned by the control program to enable a defeat protection circuit to control a fast idle "cruise" switch in the cabin to prevent a vehicle operator to attempt to override an idle shut-down mode of the control unit when enabled for a set programmed time period whereby to ensure autonomous automatic engine control by the control unit when the vehicle is at the rest condition to thereby optimize fuel efficiency.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
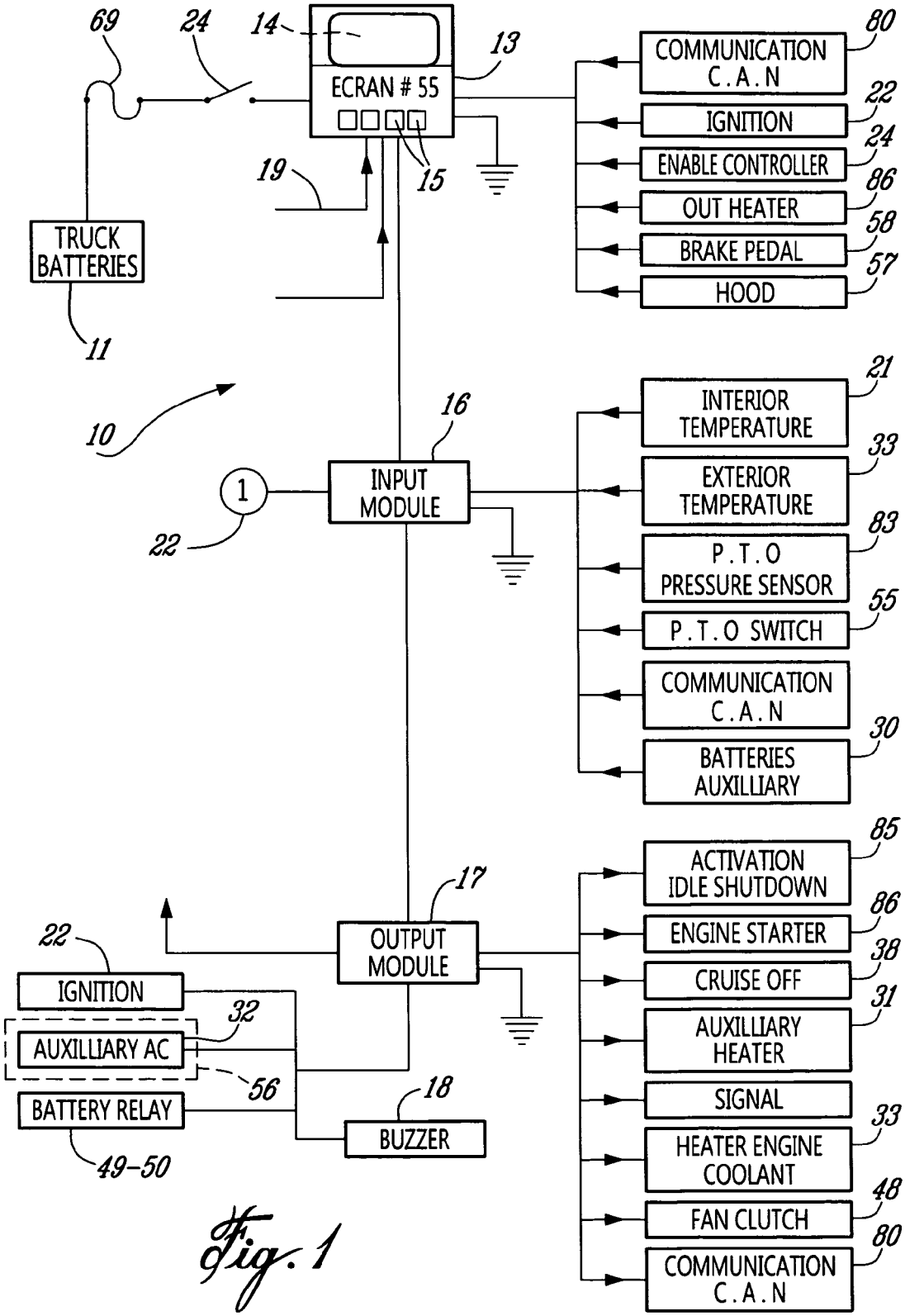
FIG. 1 is a block diagram illustrating the configuration of the automatic management and control system of the present invention.
Figure 2A:
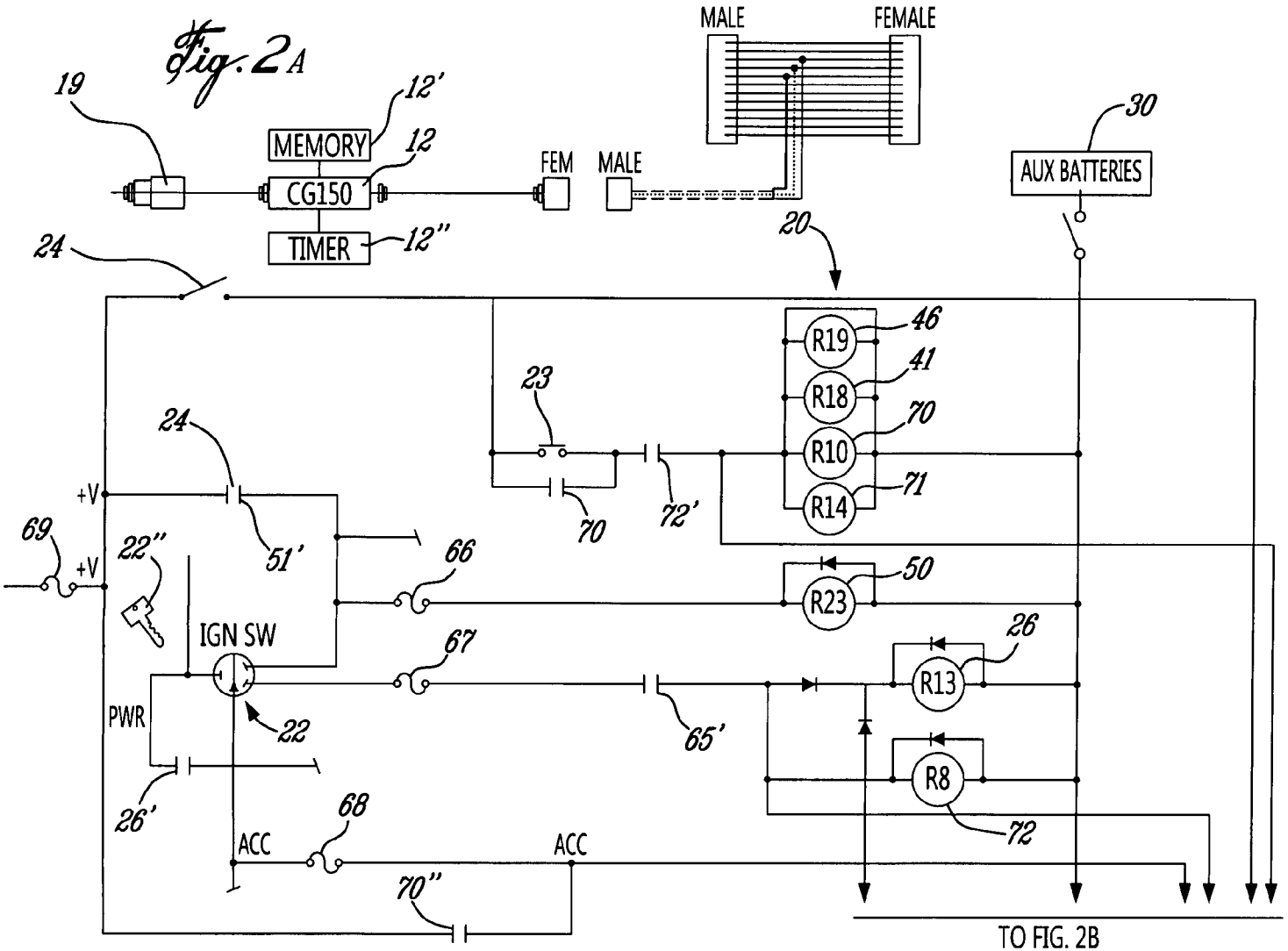
FIGS. 2A and 2B are schematic diagrams illustrating the wiring of the system including its switching solenoids and other electrical components associated therewith as well as the inputting and outputting connections.

Referring now to FIG. 1 there is shown generally at 10 the automatic management and control system of the present invention for controlling a transport motored vehicle engine idle conditions and for operating vehicle accessories and engine controls when the vehicle is at a rest condition permitting the operator to do other things while the management and control system automatically operates the engine and accessories to ensure cabin comfort and engine operating conditions with the ignition at an "on" position. The transport motored vehicle has a main battery supply 11 to support an electrical load associated therewith some of which will be described later. The system also comprises a control unit or module which incorporate a programmable computer 13, as shown in FIG. 2A, interconnected with a display means, herein a display module 13 having a display screen 14 and function keys 15 to access information displayed on the screen 14 and select a temperature mode of operation of the control unit to provide heat or air-conditioning to the cabin of the vehicle. Heat is provided during a winter mode and air-conditioning during a summer mode of operation of the vehicle depending on the vehicle's geographical location.

The control unit also has an inputting module 16 for receiving signals from various devices associated with the vehicle, as will be described later, and an outputting device 17 to activate various other accessories and controls of the vehicle. An audible alarm, herein a buzzer 18 is also associated with the control unit to sound an audible alarm when required.

With additional reference now to FIGS. 2A to 4, the automatic management and control system 10 will be described. The computer 13, as shown on FIG. 2A, is provided with a USB port connector 19 to which a portable computer (not shown) can be connected to program the computer 13, namely the memory thereof, to store an interactive management control program having instructions to operate the control unit. A timer 12" is also associated with the computer 13. The control unit and its computer 13 is interfaced with a circuit provided with actuable switching devices, herein solenoid switches, such as the solenoid coil bank 20, which are operated to change the state of their associated contacts to perform programmed functions. The control unit is also interfaced with sensors such as a cabin temperature sensor 21 for sensing the temperature in the cabin of the vehicle, and engine controls such as the ignition switch 22, as shown on FIG. 2A. The temperature sensor 21 is mounted at a convenient location, such as in the sleeper unit which communicates with the cabin. The sleeper unit is closed, when occupied, by a curtain which has minor insulation value. The control unit is also placed in operation by actuable switch means, herein switch 23 which is conveniently mounted on the dashboard of the vehicle to place the control unit in operation. However, for the control unit to be placed in operation it is also essential that the transmission of the vehicle be placed at its neutral position and that the parking brake button switch 24 be placed at a position to engage the brakes of the vehicle truck by pulling the button. This button is usually of a yellow color. The parking brake switch or actuator is connected in series with the switch 23 to permit the control unit to operate only when the vehicle truck is stationary. Accordingly, the control unit will not operate in the operator's absence, such as when the operator is sleeping or vacating the cabin for eating, etc. if the actuating switch 23 and the enabling switch, herein parking brake button 24, are not in an engaged state. The ignition switch 22 also has to be disabled at its "off" position by the operator. When the ignition switch is "off" relay contact 72' of relay coil 72 is in its normally closed position. When the enabling switch means, namely the brake switch 56 is engaged, and pressing on the actuation switch button 23, the relay coil 70 is energized thereby closing normally open contact 70' and also closing normally open contact 70". Simultaneously a relay coil 71 is also energized causing normally open contact 71' and 71" to close to render the circuit operative. A relay coil 72 disengages the ignition key when energized causing normally closed relay contact 72' to open.

After the control system 10 has been placed in operation by the operator, it is necessary for the operator of the vehicle to select a mode of operation of the control program depending on local climatic conditions. To this end there is provided on the display module 13 the function keys 15 as previously described. These keys 15 are utilized to retrieve the mode of operation of the control unit whereby to condition the program to instruct the control unit to operate in a cabin heating mode or a cabin air-conditioning mode, whereby the control module will place in operation, the heater(s) associated with the vehicle or the air-conditioning unit(s) thereof.

Figure 2B:
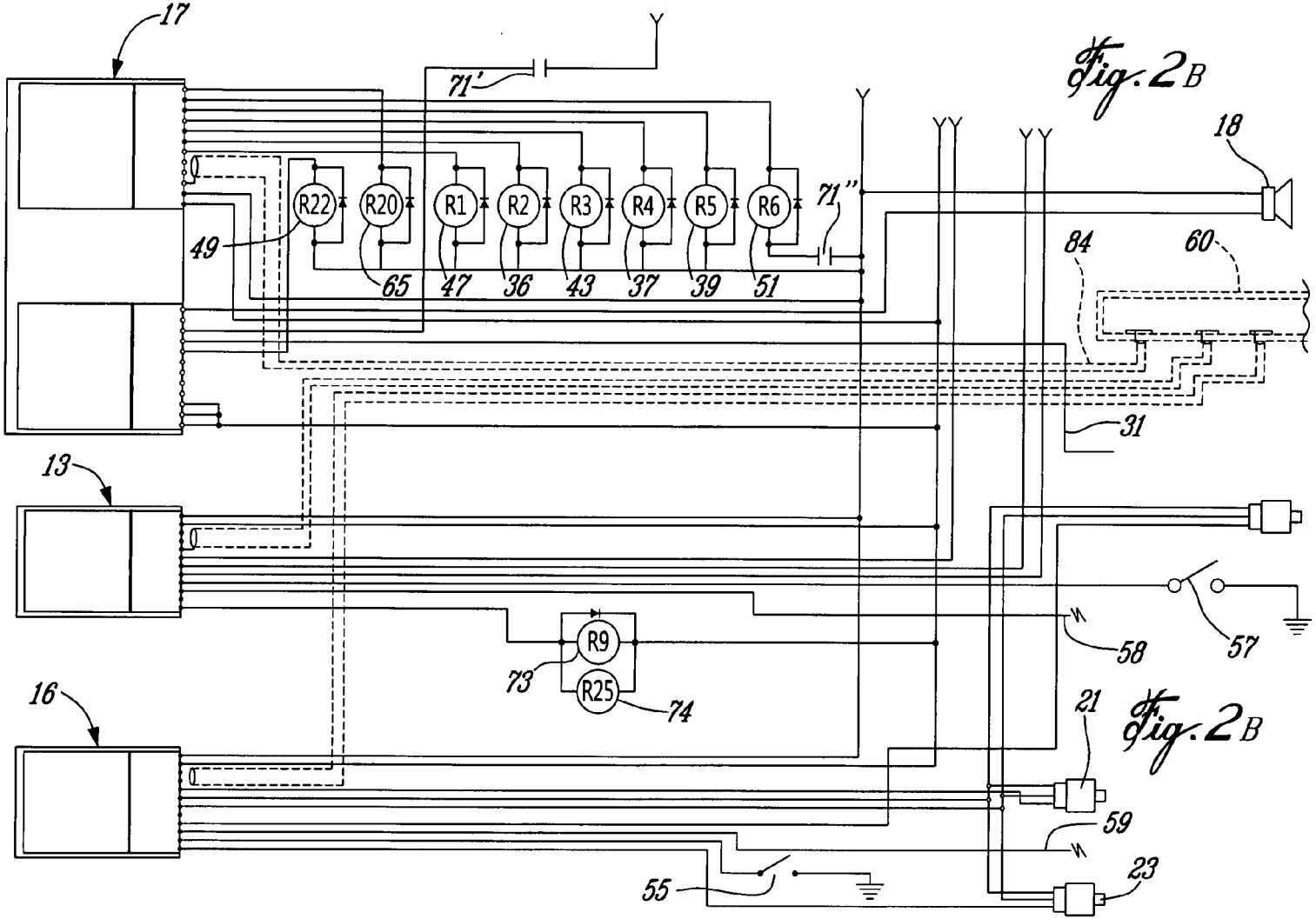

It is pointed out that the program of the system 10 of the present invention incorporates its own idle shut-down feature and operates certain functions, as now described, without the actuating switch 23 having been depressed by the operator to provide automatic management and control when the vehicle is stationary during transit with the operator. When the operator first starts the engine, relay coils 73 and 74, see FIG. 2B, are energized and their normally open contacts 73' and 74', respectively, see FIG. 3, close and the fan of the heater and air-conditioning units operate. When the temperature of the engine increases to 40° F., during 1 minute, the relay coils 73 and 74 are de-energized and the fans stop. Also, relay coil 65 is energized and its normally closed contact 65' opens for a few seconds to cut the engine switch 22 to stop the engine. Further, relay 39 is energized and its normally closed contact 39' opens to disable the "cruise idle" function which is now not available to the operator.

In the case where the operator stops the vehicle and lets the engine run at "idle", with the actuating switch 23 not depressed, the relay coils 73 and 74 are energized and their contacts 73' and 74' are closed for a timed period of 5 minutes, after which the engine is automatically stopped, unless the operator touches the brake pedal which would send a signal to the system to maintain the engine at slow idle for another 5 minutes after which the engine is shut-off with relay coil 65 energized and its contact 65' opened to cut the ignition. Also, the "cruise idle" function is no longer available as relay contact 39' opens due to the energizing relay coil 39 by the system program. To operate the "cruise idle", the vehicle must now have to be displaced. Accordingly, the operator cannot bypass the slow idle by the use of the "cruise idle" function switch in the cabin. This feature forces the operator to engage the system 10 of the present invention if he wishes to vacate the cabin for a period of time or wishes to sleep. The system 10 of the present invention will look after its comfort and ensure engine operation during adverse climatic conditions letting the operator enjoy a full rest period without worry and comfortable cabin sleeper unit temperatures and economize on fuel and engine wear.

It is further pointed out that for the control unit, namely or the system 10, of the present invention to operate it is necessary to deactivate or remove any automatic idle shut-down system that may have been installed on the transport vehicle as the control unit of the present invention as incorporated therein its own idle shut-down circuit and associated program functions.

As shown, an auxiliary battery supply 30 is an accessory of the transport motored vehicle and it is used to operate an auxiliary heater 31 and an auxiliary air-conditioning unit 32 which are mounted in a sleeper unit of the motored vehicle cabin. Such units are well known in the art. The auxiliary heater 31 and auxiliary air-conditioning unit 32 are operated by the control unit which connects the auxiliary battery supply 30 thereto when necessary for their operation and when the vehicle is at rest and depending on temperature signals received from the temperature sensor 21 inside sleeper unit.

As shown in FIG. 1, an exterior temperature sensor 33 is also provided to transmit temperature signals to the computer for display to provide the operator a means to monitor outside temperature. The control unit maintains proper temperature inside the cabin and sleeper unit within temperature parameters which are programmed into the control program of the computer. For a comfortable temperature range in the cabin, the program will control the temperature of the cabin during summer mode either by the air-conditioning unit of the truck or the auxiliary air-conditioning unit of the sleeper unit if such is provided. For example, in the summer mode if the temperature of the cabin reaches 30° C., the available air-conditioning unit is activated and when the temperature reaches a low value of 15° C. it is activated. The programmed time allowed for air-conditioning is programmed to be a maximum of 20 minutes duration.

As shown in FIG. 1, the cooling liquid of the engine is also provided with an auxiliary heater 33 to heat the cooling liquid of the engine. This heater is usually operated from the main battery supply 11 of the motored vehicle but can also be operated by the auxiliary batteries.

The control unit of the present invention has in its management control program stored parameters relating to battery charges. The battery charges are monitored by the control unit whereby these batteries are charged when required to do so depending on the set programmed parameters. In this particular application, the voltage value of the main battery supply is set to be at 12.1 volts to effectively operate the auxiliary cooling liquid heater device 33 to heat and circulate the liquid. The set programmed value of the batteries to start the engine when the unit is in air-conditioning mode is set at 11.4 volts. The set programmed value of the batteries for the ignition switch 22 to start the engine is 12 volts. The management control program also has a timer as above-described to control various timed functions. The set programmed time to recharge the batteries is 45 minutes. The program during battery recharge also allows for the engine to operate at fast idle "cruise" which is 1100 r.p.m. and during a specific programmed time period in a speed control sequence, as will be described later. The management control program also has a set time limit to start the engine once the batteries require to be charged and this is set at 10 minutes. Once the engine starts, after this time delay, it is maintained at slow idle, about 600 r.p.m., for a 5-minute period of time and then the "cruise" fast idle switching circuit 40 is activated for a 45 minutes programmed duration. Thereafter, the cruise 38 is disengaged and the low idle resumes for into the last 5 minutes of the programmed operating time of the engine.

Figure 3:
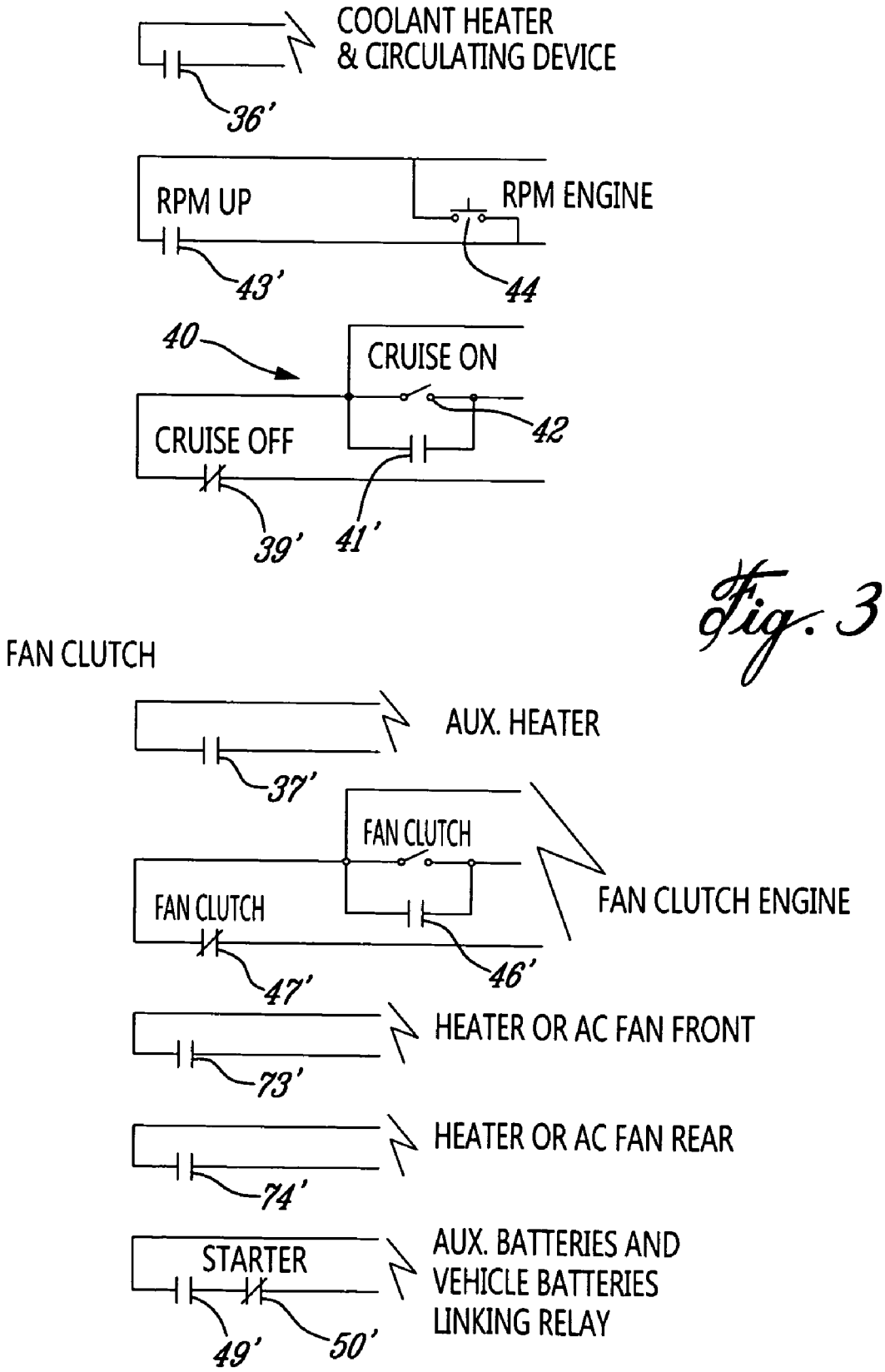
FIG. 3 is a schematic diagram illustrating the contact states of the solenoid coils associated with the vehicle accessories that are controlled by the system.

Another feature of the program, when operating in the winter mode, is that when the batteries of the main battery supply 11 are detected below 12.1 volts, the control outputting module 17 will energize the relay coil 36 thereby closing its contact 36', see FIG. 3, whereby to place in operation the auxiliary heater 33 of the cooling liquid system in order to heat the cooling liquid prior to starting the engine. During summer mode, the engine will be started but relay coils 36 and 37 will not be actuated. The relay coil 37 operates its normally open contact 37' to place in operation the auxiliary heater 31 of the sleeper unit in the cabin.

When the voltage value of the main batteries 11 drops to 12 volts, the engine is automatically started by the control system 10 which sets in operation the engine starting mode 24. The engine is operated at slow idle for a time period of 5 minutes, after which the control system will operate the engine idle speed regulator 43 (see FIG. 1) to increase the speed of the engine to 1100 r.p.m. during a programmed period of time of 45 minutes. The speed regulator 43 is actuated by actuating the relay coil 43 to close the normally open contact 43' of the coil 43. Relay coil 41 is also energized to close its normally open contact 41'. After the engine has operated at fast idle cruise for the programmed set period of 45 minutes, the batteries of the main battery supply 11 have been charged and the engine will return to the slow idle speed by de-energizing the proper relay coils as above-described and the ignition relay coil 26 will be deenergized to open the relay contact 26' and stop the engine.

A cruise "on" switch 42 is shown and available to the operator to actuate the cruise control but its time of operation is controlled by the control unit. Simultaneously relay coil 43 is also energized to close normally open contact 43' to enable the incremental change of the RPM of the motor and bypassing its incremental set switch 44.

Because the auxiliary cooling fluid heater 31 was placed in operation before the engine was started, due to the batteries having dropped too low, the temperature of the engine will therefore have increased whereby to facilitate the start of the engine and the cabin's hot water heater radiator 86 and fan associated with the engine cooling liquid. The radiator heater 86 will now be ready to blow hot air into the cabin.

The value of the batteries is continuously monitored and is displayed on the screen 14 as well as is the value of the auxiliary batteries 30, if provided to operate an auxiliary air conditioner unit 32 in the vehicle sleeper unit.

As previously described, a temperature sensor 21 is mounted in the sleeper unit and continuously provides temperature signals to the inputting module 16. During summer mode, the air-conditioning unit 32 is enable when the temperature in the cabin or sleeper unit reaches. 30° C. and shut off when the temperature reaches 15° C. The air conditioner of the truck is maintained in operation for a maximum period of time of 20 minutes. When the temperature in the cabin or the sleeper unit 56 reaches 30° C., the controller unit energizes relay coils 46 and coil 47 to thereby change the state of relay contacts 46' and 47' and thereby cause the fan 48 (see FIG. 1) of the engine to start operating. The engine will then be started by operating the ignition switch 22 after a delay of 5 seconds and the fan will be placed in operation. The air-conditioning unit of the vehicle is switched on and as soon as the temperature inside the cabin or the sleeper unit reaches 15° C. or as soon as a program time delay of 20 minutes has elapsed, which ever comes first, the controller unit will disengage the ignition switch to stop the engine. This cycle will be repeated if the temperature has not reached the low temperature range setting. The reason the fan is operated, is to dissipate heat from the engine and from under the hood of the vehicle as well as from under the floor of the cabin. The fan 48 will enable the temperature inside the cabin or the motor to fall more quickly. The fan 48 also cools the transmission case so that there is less heat as possible in the environment of the cabin. The control program also allows for the fan to be shut off 5 seconds after the motor is shut off.

For fuel efficiency, the auxiliary heating and air-conditioning units 31 and 32 of the sleeper unit are connected to an auxiliary battery supply. Batteries provide silent operation of the supply to provide for a quieter sleeping period. A connection is also provided to the display module 13 whereby the actual voltage value of the batteries will be displayed on the screen 14 of the display module in order for the vehicle operator to verify the charge on the auxiliary batteries, if he wished to do so. If the charge on the auxiliary batteries falls below a programmed value of 10.5 volts, the control unit will automatically energize relay coils 49 and 50 in order to connect the auxiliary batteries 30 in parallel with the main batteries of the battery supply 11. By changing the state of relay contacts 49' and 50', this will permit the main battery supply 11 to continue to supply voltage to the accessories without having to start the engine and consume fuel. It therefore continues to maintain a quiet state of operation. If the main vehicle batteries 11 fall below the set programmed low voltage value, the engine will then be automatically started in the fashion above-described, to recharge the main batteries as well as the auxiliary batteries. The auxiliary batteries will remain connected to the main batteries in order to always be charged. The solenoids 49 and 50 also remain closed when the key is in the ignition switch 22 at the ignition position so that the auxiliary batteries are always charged during normal operation of the engine. The voltage value of the auxiliary batteries is always accessible on the screen 14 of the display module 13 even when the system 10 is not in operation.

It is pointed out that if a fault occurs due to alternator malfunction, the battery branching relay 49 will disconnect the auxiliary batteries from the main batteries in order not to damage the auxiliary batteries. Further, if the voltage value from the alternator falls below a programmed level if 12.8 volts when the engine is in operation, the relay 49 is also deenergized by the control unit to protect the auxiliary batteries.

In order to start the engine, the control unit energizes relay coil 51 to close normally open contact 51'. The programmed time during which the relay coil 51 is energized has been set at 6 seconds. As soon as the engine starts and the tachometer has provided a speed signal to the control unit for storage in the memory and display on the screen, the relay coil 51 is deenergized. This process is usually concluded within 6 seconds. However, for protecting the ignition switch 22, if the set time limit to start the engine exceeds or attains the 6 seconds time limit and the motor has now started, the control unit will deenergize relay coil 51 after a further time delay of 5 seconds. A second attempt is then initiated by the control unit to start the engine during another time period of 6 seconds. If during the second attempt time period the engine has not started, there is no other attempt to start the engine and the buzzer 18, associated with the outputting module 17, will be actuated to generate an audible alarm to signal to the vehicle operator that there is a problem with the engine. The screen 14 will also display a fault message for the vehicle operator.

When the engine is functional and the control unit senses that the batteries remain at 12 volts or less, for a predetermined programmed period of time, the relay coil 26 will be de-energized thereby opening normally closed contact 26' cutting the supply circuit to shut off the engine and an audible alarm will be generated by the buzzer 18.

The management control program associated with the automatic management and control system of the present invention also includes additional emergency mode features when the vehicle is at rest. If the ambient temperature of the cabin falls below 18° C., then the auxiliary cooling liquid heater device is automatically actuated to heat and circulate the engine coolant. Appropriate sensors are provided to obtain these temperature readings and they are obtained from the communication system 80 which is usually available on many transport freight vehicles. A plug is usually available to tap into this computer to access its information or program. Connection 81 feeds this information to the computer 12 of the control unit 10 and these are available on the screen.

It is pointed out, that in winter mode, if the auxiliary heater does not sufficiently warms the sleeper unit or becomes inoperative for any reason, the temperature of the sleeper unit will drop and once it reaches 18° C., the control unit will turn on the auxiliary cooling fluid heater device in order to heat and circulate the cooling fluid. As the cooling fluid heater is heating and circulating the coolant, the temperature in the cabin continues to drop and as soon as it reaches 15° C. the motor will be placed in operation by operating the ignition switch, as previously described. The motor will be operated for the programmed time period of 20 minutes or until the temperature in the cabin reaches 20° C. At that time, the motor ignition switch will be switched off by energizing the appropriate relay as well as the auxiliary heater and circulating device of the coolant liquid of the engine, as previously described. If necessary, the engine can be placed back in operation.

As previously described, when the engine is engaged, it first operates at low idle speed for approximately 5 minutes and thereafter, the control module will increase the speed of the engine by actuating the cruise control circuit 43 whereby the engine can operate at a fast idle speed of about 1100 RPM during a period of 20 minutes. After such 20 minutes period, the cruise is disconnected and the engine falls back to its low idle speed for another 5 minutes.

It is also pointed out that with the control unit 10 engaged, in order to use the power take-out (PTO) actuator, it is not necessary to stop the engine. The PTO is accessible through the function keys 15 of the display module by accessing the PTO mode on the display screen. This permits the operator to operate the PTO switch 55 as shown in FIG. 2*b* to engage the system to use the hydraulic functions thereof. Once activated, the control unit will also increase the idle speed of the engine to fast idle cruise by operating the relay coils 43 and 41. However, if the hydraulic functions are not utilized for a programmed time lapse period of 1 minute, the control unit is programmed to automatically disconnect the cruise function switching circuit 40 and to return to its slow engine idle speed to conserve, fuel. After a further delay of 5 minutes, if the PTO is not used, the control unit will engage the relay 65 associated with the ignition, switch to shut off the engine. A pressure sensor 83 transmits a pressure value signal to the inputting module 16 to control the hydraulic pump of the PTO. This program switching function of the PTO prevents the operator of the vehicle from using the PTO fast idle cruise in an attempt to bypass the automatic idle shut-down mode of the control unit 10 should he wish to maintain the engine at idle for long periods of time unnecessarily consuming fuel.

As pointed out, the cruise function is controlled by the control unit and is not controllable by the vehicle operator when the vehicle is stationery. When it is required to connect the truck of the transport vehicle to a trailer, it is necessary to operate the air compressor to charge the air brake system of the trailer. In order to do so, a compressor charging mode will be accessed on the screen 14 of the display module by the keys 15 to enable the control module 10 to place the engine at fast idle cruise for a period of 5 minutes, sufficient for the compressor to charge the trailer compressed air reservoir. After the 5 minutes at fast idle cruise the engine will be brought down to slow idle for another 5 minutes and then stopped.

Another safety feature of the automatic management and control system 10 of the present invention is to monitor a hood detection switch 57 to provide a signal to the control unit which will cause the buzzer 18 to sound an audible alarm and also provide a display on the screen 14 of the display module to indicate that the hood needs to be engaged before the engine can be started.

Also provided is a connection to the brake pedal, herein connection 58, to detect when the brake pedal is applied. As soon as the brake pedal is depressed, the control unit will detect that the brake lights have been fed current and the control unit will stop the engine if in an idle mode and/or cancel the automatic engine start feature of the control program.

The sensor connection to the auxiliary battery is provided by the wire connection 59 shown in FIG. 2*b*. As also illustrated in FIG. 2B, connections 84, shown in doted lines, accesses the C.A.N. Network computer 60 to provide its monitored and stored information to the system computer 13.

Various other security features are associated with the automatic management and control system 10 of the present invention. For example, the control system can detect if the transmission, instead of being placed at neutral is at another position, with the vehicle stationary and the parking brake on. This is achieved by monitoring the main batteries 11. In such a situation, the batteries will drop drastically and as soon as they indicate a voltage value of 9.5 volts there is a time delay of 2 seconds for the control unit to stop the idling engine. This is to prevent damage to the solenoid and starter of the vehicle electrical system and to also protect the driver against accidental movement of the vehicle. Also, as previously described, if the parking brake is disconnected while the control unit is engaged, this will automatically stop the engine.

A feature of the control unit and its control program, is that if the ignition key 22' is removed, see FIG. 2A, when the ignition switch 22 is in the "off" position, no alarm will sound and the control module will continue to be in service. This provides for the operator to vacate the cabin and lock the doors of the transport vehicle. The control unit will remain operative to manage and operate the engine and accessories associated with the vehicle when there is a need to do so.

Figure 4:
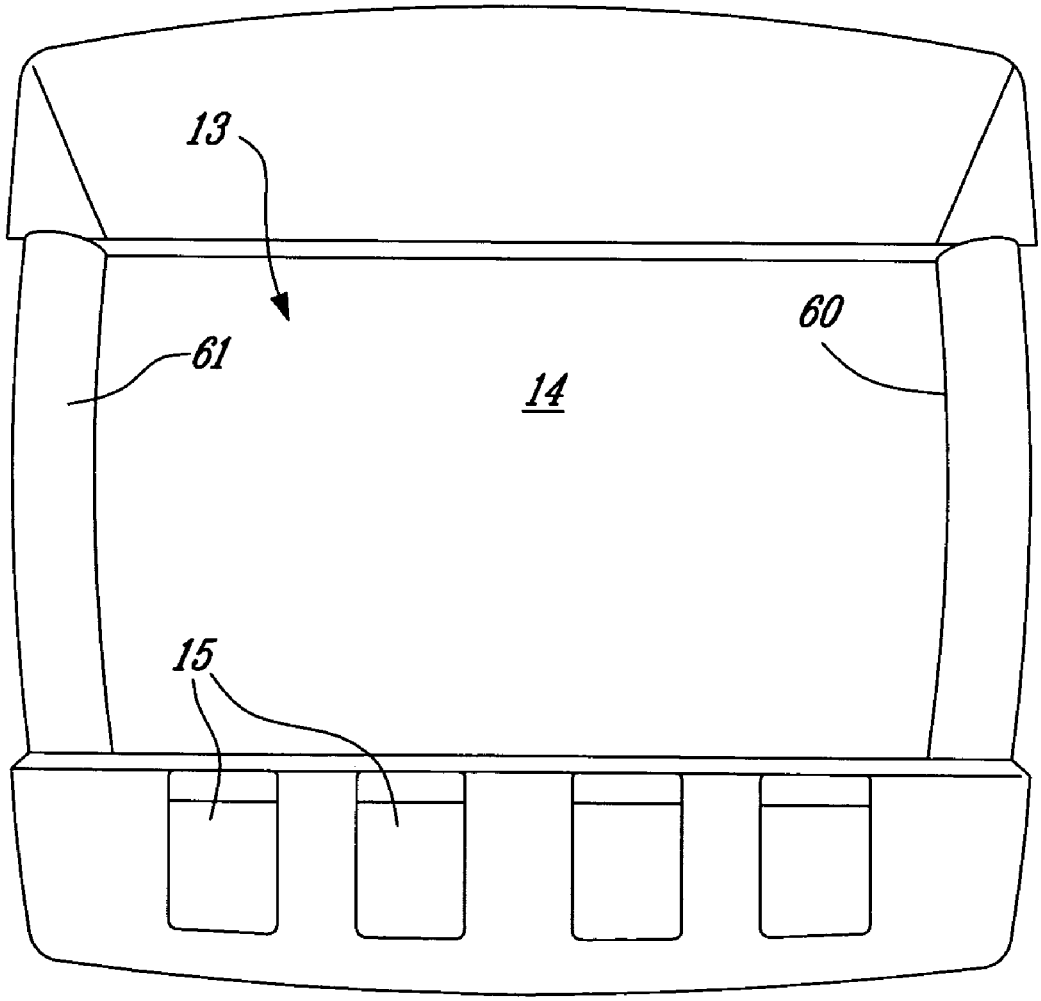
FIG. 4 is a schematic illustration of the display module and its associated interactive keys for accessing programmed information and data displayable on the screen and for selection of mode of operation.

With reference to FIG. 4, there is shown the display module 13 and it is provided with light bars 60 and 61 on opposed sides of the screen 14. These two light bars provide for yellow warning lights which are actuated when there are minor abnormalities with the engine as detected by the C.A.N. computer 80. The buzzer 18, which is conveniently located in the relay module PCB, will also sound an alarm which can be deactivated by the operator by depressing an appropriate key 15 associated with the displayed function. If such an alarm is sound, during the sleeping period of the operator, the operator merely checks on the screen what the error message is, and he can deactivate the audible alarm and continue is sleep depending on the severity of the message. During the next day, the engine fault detected can be verified by certified mechanics. Also provided in these light bars is a red engine warning light and when such is activated, the engine starting program function is no longer available. The operator must no longer try to operate the engine and call road service. These warning lights are commonly used in transport vehicle but have been conveniently integrated into the display module 13 of the present invention. Another safety feature is that if the engine, during idle, exceeds 1800 r.p.m.; the control unit will automatically stop the engine and sound an audible alarm and at the same time display a message on the screen to make the operator aware of a possible engine problem.

The control program also instructs the control unit to stop the operation of the fan of the vehicle heater radiator once the engine has reached a temperature of 40° F. When the engine is cold at the time of startup and as soon as the temperature thereof attains 40° F., there is a delay of 5 minutes before the radiator fan of the vehicle stops during the winter mode of operation. The fan is stopped by the control unit deenergizing the relay coils 73 and 74 causing normally open contact 73' to assume its open condition and normally open contact 74' to also open. Relay coil 74 controls the fan of the heater radiator. However, when the engine is warm at start-up there is a programmed delay of 1 minute before the fan of the cabin and the cabin radiator heater, as well as the engine, are stopped. In order for the fan of the cabin radiator heater(s) and the engine to remain operative, the transport vehicle must be in motion and attain a speed of 3 km per hour. The control program also maintains the fan of the cabin radiator heater(s) in operation for 5 minutes after the transport vehicle is stopped.

Another feature of the automatic management and control system 10 of the present invention is that the control program also allows that in the event that the alternator of the electric system becomes defective, during winter conditions, the vehicle operator will switch "on" the auxiliary heater 32 of the sleeper unit, if such is provided, instead of engaging the cabin radiator heater which would otherwise draw a lot of amperage from the main batteries 11.

A still further feature is that the control program permits the vehicle operator, by the use of the function keys and the display module, to program the temperature of the auxiliary heater 33 of the engine cooling liquid to heat and circulate the liquid even if the control unit is not operative. The control unit also provides, with its integrated timer unit of the computer 13, a display on the screen of the time that the engine has been operative when the transport motored vehicle is at rest. Such information is accessed from the C.A.N. computer 80.

The management and control system of the present invention also monitors the batteries in the event that there is sudden voltage drop, due to a peak demand of battery voltage of the inverter, for example, if the operator uses a microwave oven in the auxiliary outlet provided in the cabin or sleeper unit. If the control module detects two sudden battery voltage drops under 11.8 volts and during a period of time exceeding 30 seconds, during a monitored predetermined time limit, for example 10 minutes, the control unit will automatically start the engine to recharge the batteries. The engine will operate for a time period of 20 minutes at fast idle "cruise", during the previously described cycle where the engine is engaged at low idle for 5 minutes, then at fast idle for 20 minutes and back down to low idle for the last 5 minutes and then idle shut-down will occur. The automatic idle shut-down switching function 85 (see FIG. 1) is effected by energizing relay coil 65 thereby changing the state of normally closed relay contact 65' causing an open circuit to condition the ignition switch 22 to its "off" state to thereby shut-down the engine.

As shown in the wiring circuit of diagram FIGS. 2A and 2B, the circuit is protected at the ignition switch connections by fuses 66, 67 and 68. A main power supply protection fuse 69 is also provided.

Figure 5:
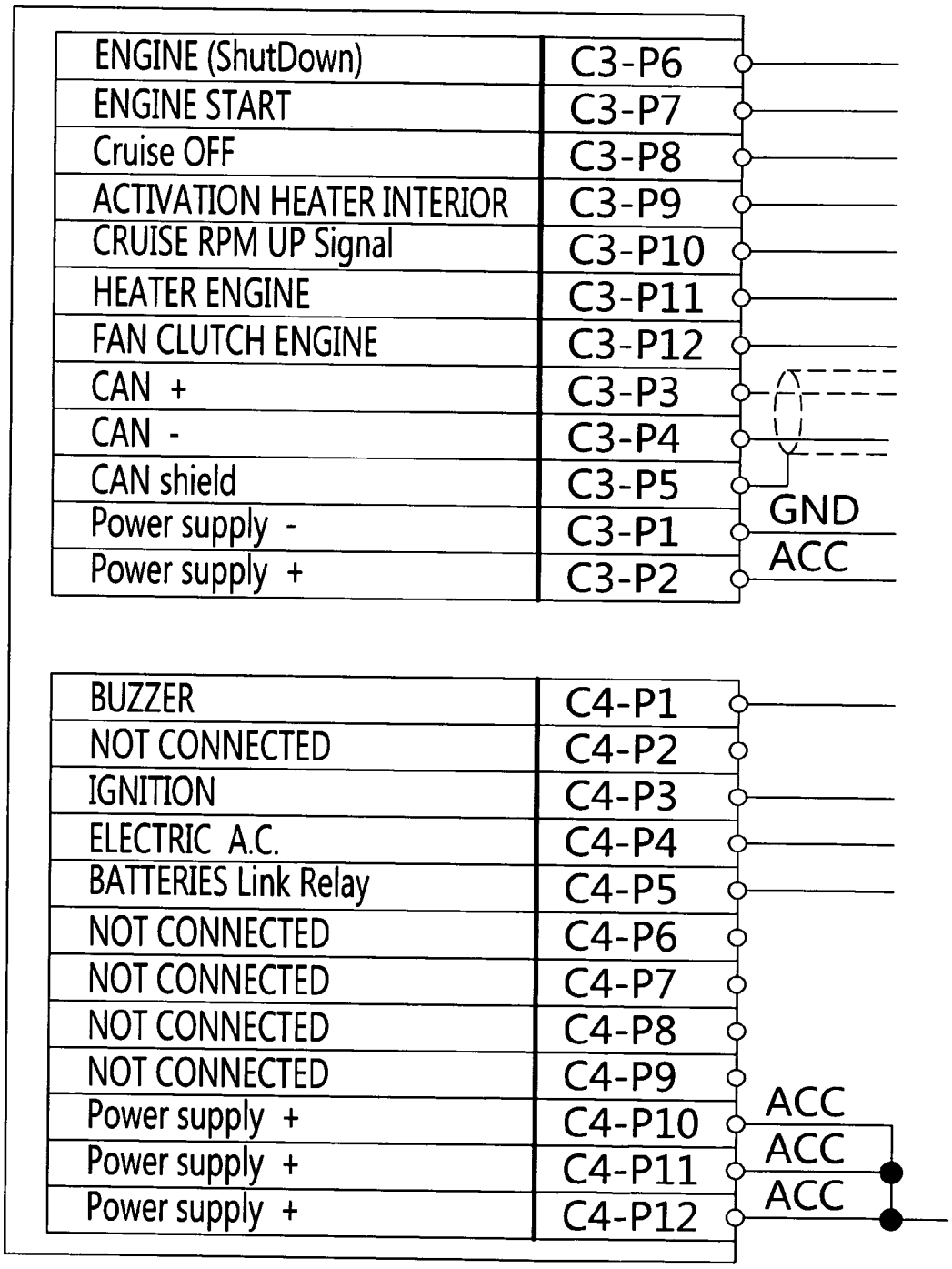
FIG. 5 to 7 are enlarged views of the outputting module, the inputting module and control module shown in FIG. 2A.
Figure 6:
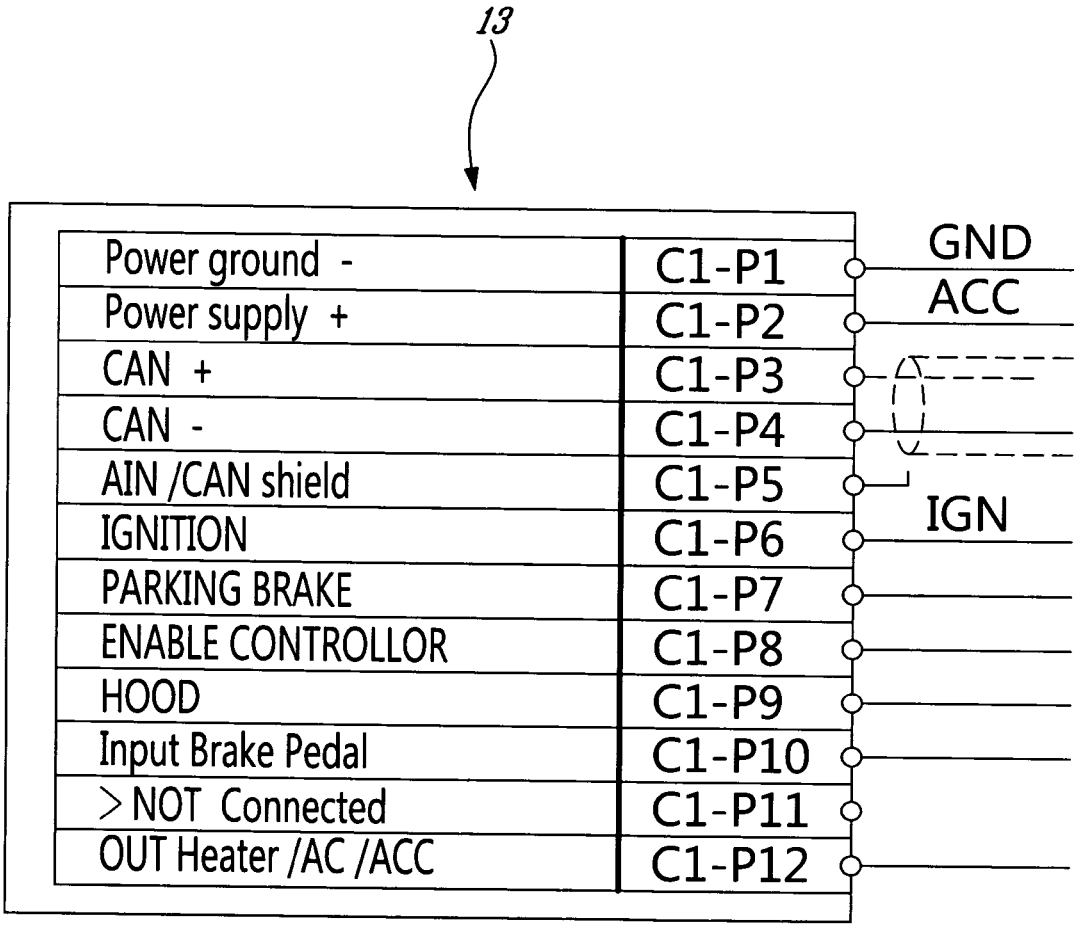
Figure 7:
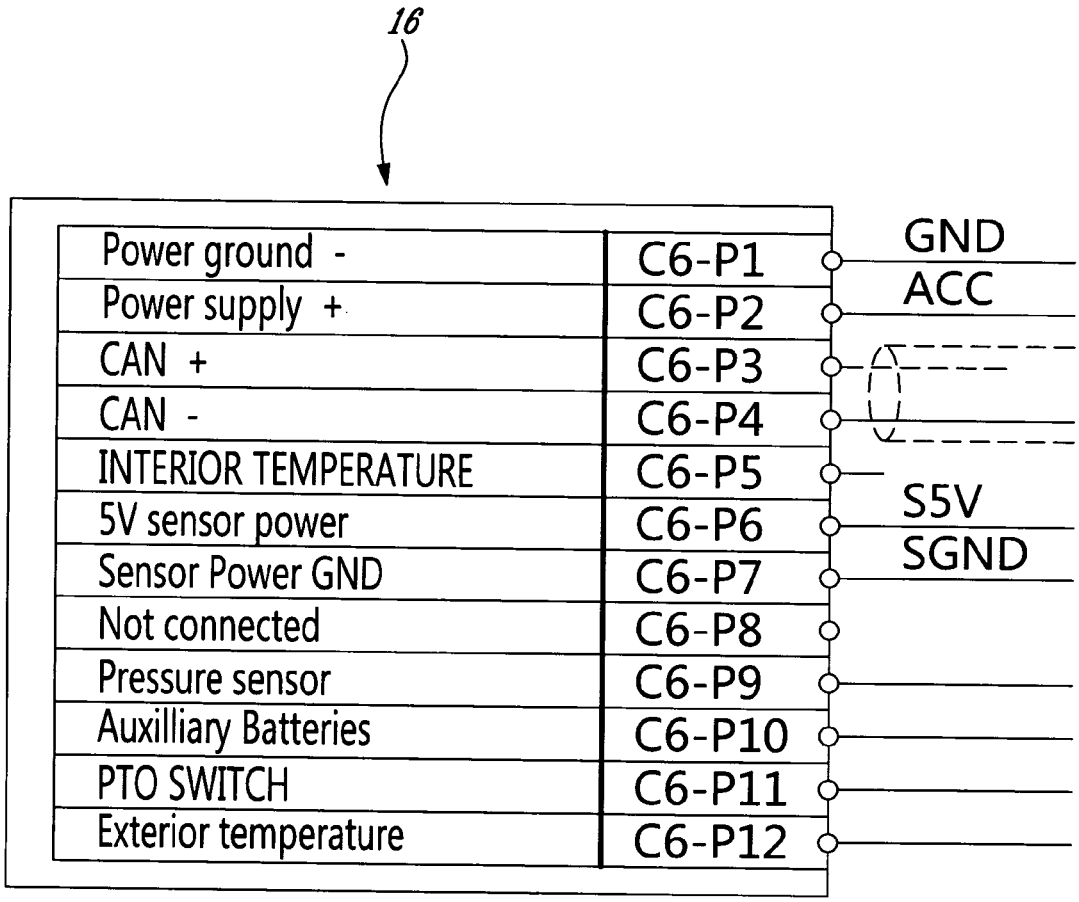

FIGS. 5, 6 and 7 are simply enlarged views of connections of the outputting module 17, the connections of the inputting module 16 and the connections of the display module 13.

It is within the ambit of the present to cover any obvious modifications of the preferred embodiment described herein provided such modifications fall within the scope of the appended claims.

The invention claimed is:

1. An automatic management and control system for controlling a transport motor vehicle engine idle conditions, operation of vehicle accessories and engine controls when said vehicle is at a rest condition; said transport motor vehicle having a main battery supply to support an electrical load associated therewith, said system comprising a control unit with a programmable computer having a memory for storing instructions for execution of an interactive management control program by said control unit, a timer associated with said computer; said control unit being interfaced with actuable switching devices to control said vehicle accessories, and said engine controls; actuable switch means to enable said control unit through enabling switch means when said vehicle is at said rest condition, and when a transmission of said vehicle is at a neutral position and when an ignition switch of said vehicle is at a disabled OFF position; display means having means to access programmed parameters and monitored parameters associated with said control unit, said sensor means and said engine controls; mode selection switch means to condition said control program to operate in one of a cabin heating mode or a cabin air-conditioning mode, sensor means monitors a cabin temperature sensor to provide temperature signals representative of actual cabin temperature to said control unit, said control unit being conditioned by said control program to enable a defeat protection circuit to control a fast idle cruise switch in said cabin to prevent a vehicle operator to attempt to override an idle shut-down mode of the control unit during which said engine is operated at slow idle for a set programmed time period whereby to ensure autonomous automatic engine control by said control unit when said vehicle is at said rest condition to thereby optimize fuel efficiency, said defeat protection circuit having disabling switching means to disable said idle shut-down mode of said control unit and requiring disabling said enabling switch means by said vehicle operator and displacing said vehicle from said rest condition to permit said vehicle operator to re-enable said control unit and idle shut-down mode.

2. A system as claimed in claim 1 wherein said enabling switch means is constituted by a parking brake engaging element located in a cabin of said vehicle and operable by the vehicle operator.

3. A system as claimed in claim 1 wherein there is further provided an exterior temperature sensor to provide temperature signals representative of actual temperature outside said cabin.

4. A system as claimed in claim 1 wherein said display means is a display module having a screen and finger actuable keys to select desired programmed function displays on said screen by a user person.

5. A system as claimed in claim 1 wherein said cabin heating or air-conditioning mode each have set low and high temperature values stored in said control program to define a comfortable temperature range for said cabin.

6. A system as claimed in claim 1 wherein said actuable switching devices are solenoid switches, each of said solenoid switches having an energizable coil and switch contacts set in a normally open or normally closed state.

7. A system as claimed in claim 5 wherein said vehicle accessories comprise an auxiliary heating device and an auxiliary air-conditioning device secured in a sleeper unit of said cabin, and an auxiliary d.c. battery supply connectable to said auxiliary heating device or said auxiliary air-conditioning device through an associated one of said actuable switching devices dependent on a selection of said mode selection switch means by the vehicle operator.

8. A system as claimed in claim 7 wherein said auxiliary d.c. battery supply is connectable in parallel with said main battery supply of said vehicle through a connecting switch contact of one of said actuable switching devices which is actuable by said control unit when the actual voltage of said auxiliary d.c. battery supply falls below a set voltage value programmed in said memory of said computer, and voltage sensing means to sense said actual voltage of said auxiliary d.c. battery supply to provide voltage signals to said control unit.

9. A system as claimed in claim 7 wherein said mode selection switch means is a finger actuable key associated with a screen of said display module to select one of said cabin heating or cabin air-conditioning mode displayed on said screen.

10. A system as claimed in claim 8 wherein said voltage means supplies actual voltage value signals of said main battery supply to said control unit, said interactive control program having a low voltage value rating of said main battery supply stored in said memory whereby to cause said control unit to enable an ignition one of said switching devices to engage said ignition switch to start said engine at said slow idle speed for a first programmed period of time, to actuate said fast idle cruise mode after the expiration of said first period of time for a second longer period of time, and thereafter to return to said slow idle speed for a third period of time after which said ignition one of said switching devices is returned to its initial state with said main battery supply having been recharged.

11. A system as claimed in claim 10 wherein said ignition one of said switching devices remains enabled when said ignition switch is enabled during normal operation of said vehicle to fully charge said auxiliary d.c. battery supply.

12. A system as claimed in claim 8 wherein said connecting switch contact of said actuable switching devices is disabled to disconnect said parallel connection upon said control unit detecting a fault of an alternator of said vehicle or upon said alternator falling below a programmed voltage value set in said memory of said computer.

13. A system as claimed in claim 1 wherein there is further provided an auxiliary engine cooling liquid heater and circulating device associated with said engine for heating and circulating said cooling liquid when said control unit is programmed to operate in said cabin heating mode by said mode selection switch means, and sensor means including a voltage sensor for supplying actual voltage value signals of said main battery supply to said control unit, said interactive control program having a low voltage value rating of said main battery supply stored in said memory whereby to cause said control unit to enable said liquid heater and circulating device for a programmed period of time.

14. A system as claimed in claim 13 wherein after said programmed period of time that said liquid heater and circulating device is enabled said interaction control program will cause said control unit to actuate an ignition one of said switching devices to enable said ignition switch to start said engine at said slow idle speed for a first programmed period of time, to actuate said fast idle cruise mode after the expiration of said first period of time for a second longer period of time to operate said engine at fast idle cruise speed, and thereafter return to said slow idle speed for a third period of time for effecting one or a combination of:

i) providing heat to said cabin by a cabin heater of said vehicle;

ii) maintaining said engine above a set programmed temperature or;

iii) charging said main battery supply.

15. A system as claimed in claim 1 wherein an auxiliary d.c. battery supply is connected in parallel with said main battery supply of said vehicle through a connecting switch contact of one of said actuable switching devices which is actuable by said control unit when the actual voltage of said auxiliary d.c. battery supply falls below a set voltage value programmed in said memory of said computer, and voltage sensing means to supply an actual voltage value to said control unit.

16. A system as claimed in claim 1 wherein when said control unit is conditioned by said mode selection switch means to operate in said air-conditioning mode and when said temperature signals of said cabin temperature sensor reach a set programmed high temperature value said control unit will operate an ignition switch one of said switching devices to enable said ignition switch to start said engine and an air-conditioning unit associated therewith until the temperature in said cabin reaches a set programmed low temperature value or a programmed time delay after which said ignition one of said switching devices is returned to its initial state.

17. A system as claimed in claim 16 wherein a fan of said engine is enabled by a fan enabling contact of one of said switching devices during a predetermined period of time during the time of operation of said engine.

18. A system as claimed in claim 1 wherein when said control unit is conditioned by said mode selection switch means to operate in said cabin heating mode and said temperature signal of said cabin temperature sensor reaches a first set programmed low temperature sensor value said control unit will actuate an auxiliary engine cooling liquid heater associated with said engine for heating said cooling liquid, said temperature signals when reaching a second set lower temperature value, due to continuing drop in temperature in said cabin, causing said control unit to enable said ignition switch through an ignition switch one of said actuable switching devices to start said engine for a predetermined set time limit or upon a high temperature value stored in said memory being attained.

19. A system as claimed in claim 18 wherein said engine when in operation during said predetermined time limit is caused to operate, by said control unit and enabled ones of said actuable switching devices, in a predetermined speed sequence comprised of said slow idle speed for a first programmed period of time, to a fast idle cruise speed for a second longer period of time and thereafter return to said slow idle speed for a third period of time.

20. A system as claimed in claim 1 wherein one of said vehicle accessories is a power take-off (PTO) actuator to permit said engine to operate at said fast idle cruise mode where the turning speed of said engine is increased above the slow idle speed, said PTO actuator coupling said engine to a hydraulic system having hydraulic actuators, and sensor means for sensing the state of said hydraulic actuators, said interactive program providing a set expiration time delay to disconnect said fast idle cruise mode if said actuators are not engaged after said expiration time delay and causing said engine to operate at said slow idle speed for a set time period after which said control unit will operate an ignition switch one of said switching devices to disable said ignition switch to stop said engine.

21. A system as claimed in claim 1 wherein said engine control comprises a fast idle cruise programmed function in said interactive program which can be enabled by the operator to operate an air compressor of a trailer to be connected to a tractor cab, said fast idle cruise function being available by a finger actuable key associated with said screen module upon accessing said programmed function, said programmed function permitting operation of said fast idle cruise engine speed for a pre-set period of time after which said control unit causes said engine to revert to slow idle speed for a preset period of time after which said engine is stopped by operation of an ignition switch one of said switching devices to disable said ignition switch to stop said engine.

22. A system as claimed in claim 1 wherein there is further provided a hood disengaged detection switch which provides a signal to said control unit whereby said control unit when placed in operation by said actuable switch means will cause said control module to generate an audible alarm and a display message on said screen indicating that the hood requires to be engaged.

23. A system as claimed in claim 1 wherein said interactive control program comprises an engine start default feature to protect a starter motor of said vehicle, an ignition switch one of said actuable switching devices being enabled by said control unit when instructed by said computer to operate said ignition switch to start said engine during a predetermined programmed time interval, sensor means including a tach sensor to monitor the operational speed of said engine, said ignition switch one of said actuable switching devices being disabled if said tach sensor has not detected continuous operation of said engine after a second attempt to start said engine during a second time interval, said control unit actuating an audible alarm and providing a message on said screen of an engine default.

24. A system as claimed in claim 1 wherein an ignition one of said actuable switching devices is disabled by said control unit to stop said engine if operating in said slow idle mode upon detection of the application of a brake pedal of said vehicle.

25. A system as claimed in claim 1 wherein said control unit when operative by said actuable switch means, with said ignition switch at said disabled OFF position, is maintained operative with a key of said ignition removed therefrom and the vehicle operator vacant from said cabin with vehicle cabin doors locked.

26. A system as claimed in claim 1 wherein said display means is a display module having a screen and finger actuable keys, said display module having warning lights to indicate engine malfunction and upon such detection by said control unit an audible alarm is actuated and a display message is generated on the screen to indicate the severity of the engine malfunction for remedial action by the vehicle operator.

27. A system as claimed in claim 1 wherein when said mode selection switch means is set at said cabin air-conditioning, mode said control unit will operate selected ones of said actuable switch means to disable an auxiliary sleeper cabin heater and an engine cooling liquid heater and circulating device.

28. A system as claimed in claim 1 wherein said programmable computer is provided with a USB port for future programming by a portable computer said program providing for all inputted information to be displayed on said screen for diagnostic evaluation.

29. A system as claimed in claim 1 wherein said control program causes said control unit to operate an ignition switch one of said actuable switching devices within a set predetermined time period to disable said ignition switch to stop said engine at said normal slow idle, said ignition switch being re-enabled for said set predetermined time period in the event said engine is stopped by the application of a brake pedal of said vehicle, said control unit preventing further automatic engine re-start by enabling said ignition switch one of said actuable switching devices and actuating further actuable switching devices to prevent operation of cabin temperature control devices.

30. A system as claimed in claim 1 wherein said interactive control program includes set parameters to i) monitor main and auxiliary battery supply charges;
ii) operate said engine at normal slow idle speed and fast idle cruise speed at programmed times of operation;
iii) monitor engine temperature, cabin temperature and outside temperature;
iv) operate an auxiliary engine cooling liquid heater and circulating device;
v) charge main and auxiliary batteries;
vi) operate an auxiliary cabin sleeper unit heater and air-conditioning unit;
vii) display and sound alarm conditions;
viii) monitor engine conditions and associated engine devices; and
ix) display on a screen the control program functions and other parameters of monitoring devices for access by a user person through associated keys, and display all said control program functions and inputted parameters and information for diagnostic purpose.

31. A system as claimed in claim 1 wherein there is further provided sensor means to detect load surges on said main battery supply and upon detection of at least two of said surges within a predetermined time interval said control unit will operate said ignition switch to start said engine to charge said main battery supply.

32. A system as claimed in claim 16 wherein an auxiliary air-conditioning device of a sleeper unit of said cabin is enabled by said control unit to cool said sleeper unit, said high temperature value being attained when said auxiliary air-conditioning device fails to cool said sleeper unit.

* * * * *